US010383419B2

(12) United States Patent
Lu

(10) Patent No.: US 10,383,419 B2
(45) Date of Patent: Aug. 20, 2019

(54) BUOYANCY DRY BAG

(71) Applicant: Kuo-Pin Lu, Miaoli County (TW)

(72) Inventor: Kuo-Pin Lu, Miaoli County (TW)

( * ) Notice: Subject to any disclaimer, the term of this patent is extended or adjusted under 35 U.S.C. 154(b) by 0 days.

(21) Appl. No.: 15/983,846

(22) Filed: May 18, 2018

(65) Prior Publication Data

US 2019/0000202 A1 Jan. 3, 2019

(30) Foreign Application Priority Data

Jul. 3, 2017 (CN) ..... 2017 1 0532059

(51) Int. Cl.
*A45C 11/22* (2006.01)
*A45C 3/00* (2006.01)
*A45C 13/10* (2006.01)

(52) U.S. Cl.
CPC ..... *A45C 11/22* (2013.01); *A45C 3/001* (2013.01); *A45C 13/1092* (2013.01)

(58) Field of Classification Search
CPC ..... A45C 11/22; A45C 3/001; A45C 13/1092
USPC ..... 383/3
See application file for complete search history.

(56) References Cited

U.S. PATENT DOCUMENTS 4,155,453 A * 5/1979 Ono ..... B65D 81/052 206/522
4,184,596 A * 1/1980 Avery ..... B65D 81/075 206/522
4,262,801 A * 4/1981 Avery ..... B65D 81/075 206/522
6,080,027 A * 6/2000 Rodemann ..... B63B 43/12 441/38
7,458,681 B1 * 12/2008 Redding ..... A45C 11/04 206/5
2005/0061409 A1 * 3/2005 Chung ..... A45C 7/0081 150/110
2009/0274395 A1 * 11/2009 Orion ..... A45C 7/0081 383/3
2011/0167863 A1 * 7/2011 Herrbold ..... A45C 13/02 62/457.1
2014/0248003 A1 * 9/2014 Mogil ..... A45C 3/001 383/3

FOREIGN PATENT DOCUMENTS

CN 204580206 U * 8/2015
WO WO-2010044849 A1 * 4/2010 ..... A45C 7/0095

OTHER PUBLICATIONS

Machine translation of the description of CN-204580206-U.*

* cited by examiner

*Primary Examiner* — Jes F Pascua
(74) *Attorney, Agent, or Firm* — LeClairRyan

(57) ABSTRACT

A buoyancy dry bag includes an air valve unit, and first and second body parts that are connected to each other and that cooperatively define a receiving space. The first body part has a lining layer made of thermoplastic polyurethane, and an external layer structure having an inner layer disposed at an outer side of the lining layer and made of thermoplastic polyurethane, an outer layer contacting an outer surface of the inner layer and made of polyester, and a pattern layer contacting the outer layer. The first body part defines a first air chamber between the lining layer and the inner layer. The air valve unit includes a first air valve mounted to the external layer structure for injection of air into the first air chamber therethrough.

10 Claims, 9 Drawing Sheets

BUOYANCY DRY BAG

CROSS-REFERENCE TO RELATED APPLICATION

This application claims priority of Chinese Patent Application No. 201710532059.9, filed on Jul. 3, 2017.

FIELD

The disclosure relates to a waterproof bag, and more particularly to a buoyancy dry bag.

BACKGROUND

Buoyancy dry bag can be hung on a user's body while doing outdoor water sports. In addition to having life-saving and alarming functions, the user can keep personal items in a buoyancy dry bag for convenient storage. Therefore, buoyancy dry bag is widely used.

A conventional buoyancy dry bag, as disclosed in Chinese Utility Patent No. CN204580206U, includes two tarpaulin films each of which is coated with a PVC layer for providing waterproof function and which are connected to each other to constitute a body of the conventional buoyancy dry bag. However, it is relatively difficult to color or print fine patterns on the PVC layers. Moreover, PVC is toxic and not eco-friendly, and contact with a human body for an extended period of time should be avoided.

SUMMARY

Therefore, an object of the disclosure is to provide a buoyancy dry bag that can alleviate at least one of the drawbacks of the prior art.

According to the disclosure, the buoyancy dry bag includes a first body part, a second body part, and an air valve unit.

The first and second body parts are connected to each other and cooperatively define a receiving space. The receiving space has a top opening. The first body part has a lining layer that is made of thermoplastic polyurethane, and an external layer structure that has an inner layer disposed at an outer side of the lining layer and made of thermoplastic polyurethane, an outer layer contacting an outer surface of the inner layer and made of polyester, and a pattern layer contacting an outer surface of the outer layer.

The first body part further has a top edge, and a connecting edge that interconnects opposite ends of the top edge. The top edge and the connecting edge cooperatively define a periphery of the first body part. The first body part further has a first sealing portion and a second sealing portion. The first sealing portion is spaced apart from the top edge of the first body part, includes a portion of the lining layer and a portion of the external layer structure sealed to the portion of the lining layer, and has opposite first and second ends intersecting respectively opposite sections of the connecting edge of the first body part. The second sealing portion extends along the connecting edge, is connected to the first and second ends of the first sealing portion, and includes another portion of the lining layer and another portion of the external layer structure sealed to the another portion of the lining layer. The first and second sealing portions cooperatively define a first air chamber between the lining layer and the inner layer.

The air valve unit includes a first air valve mounted to the external layer structure of the first body part and being openable to permit injection of air into the first air chamber therethrough.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
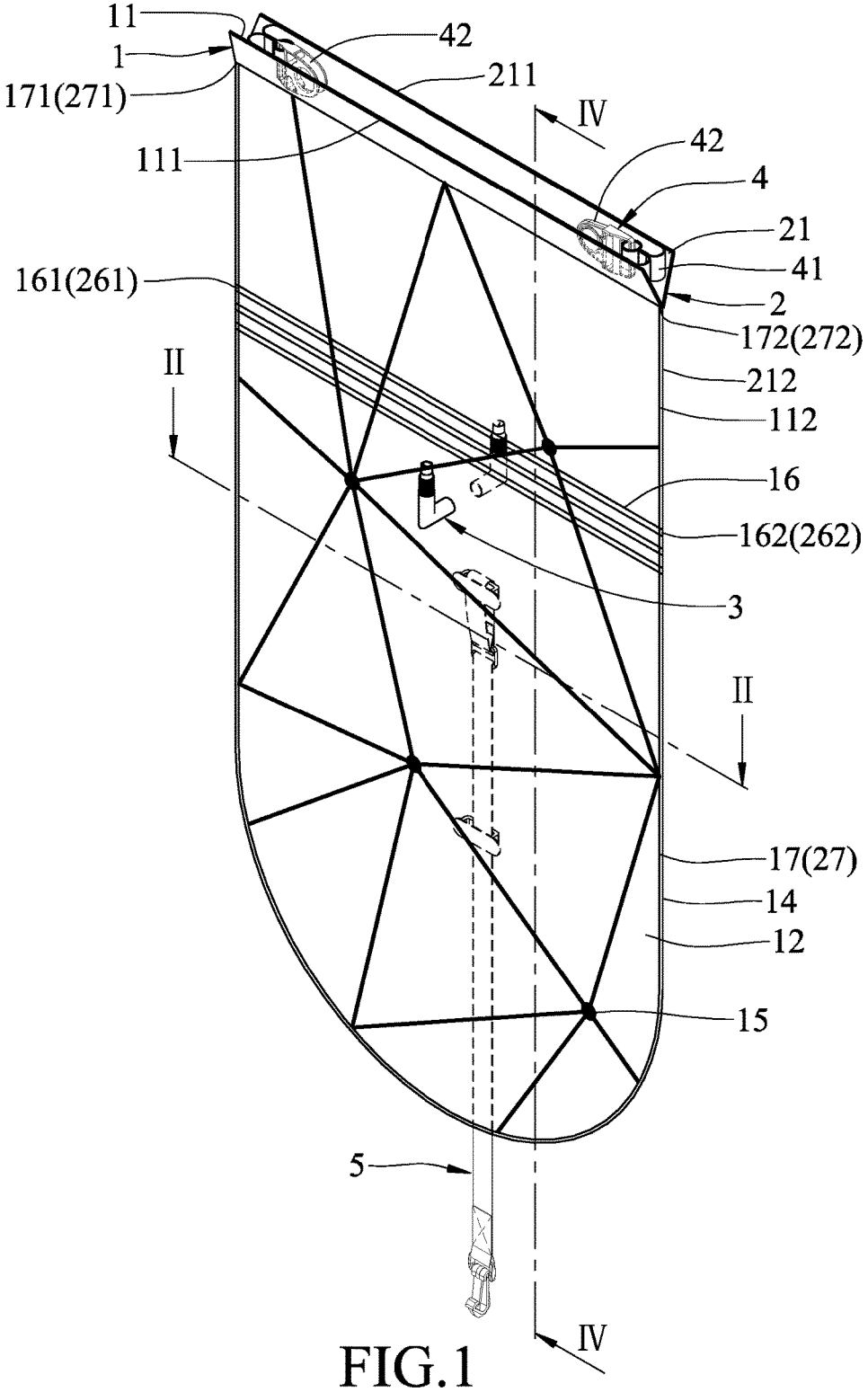
FIG. 1 is a perspective view illustrating a first embodiment of a buoyancy dry bag according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
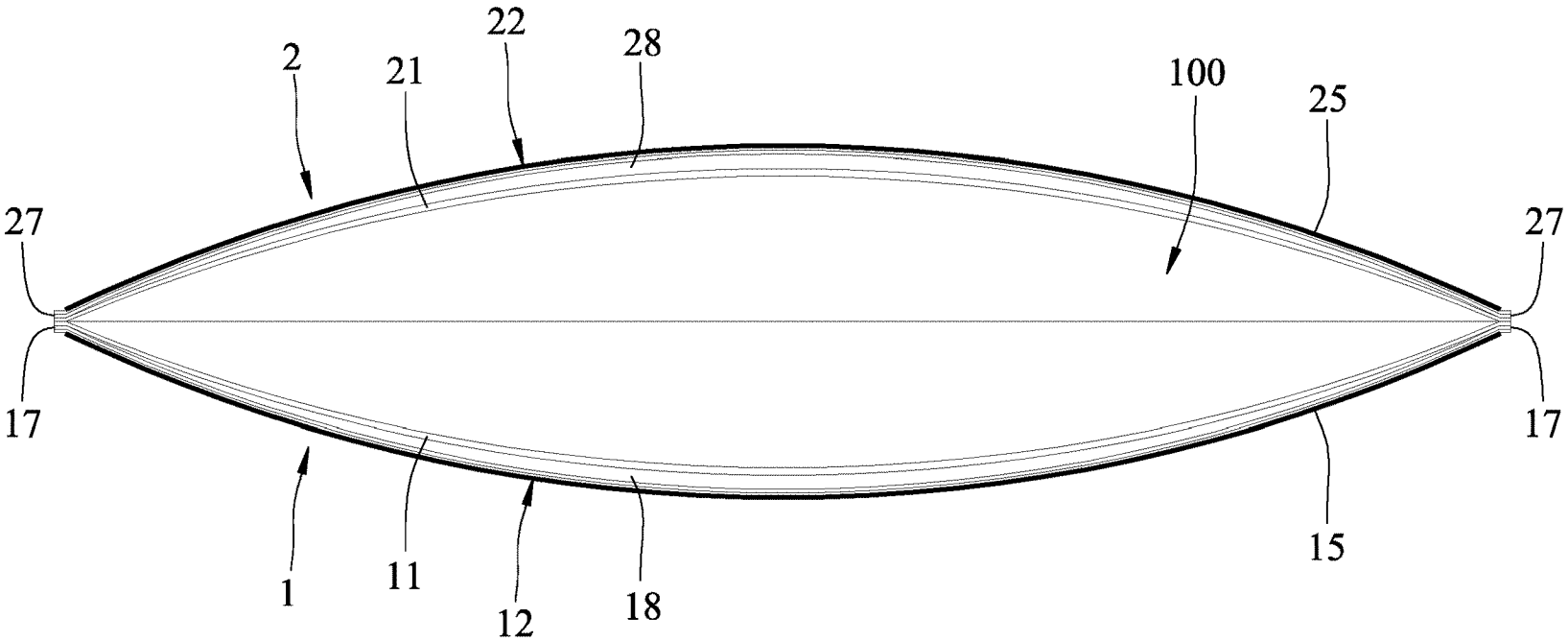
FIG. 2 is a sectional view take along line II-II of FIG. 1, illustrating a first body part and a second body part of the first embodiment.
Figure 3:
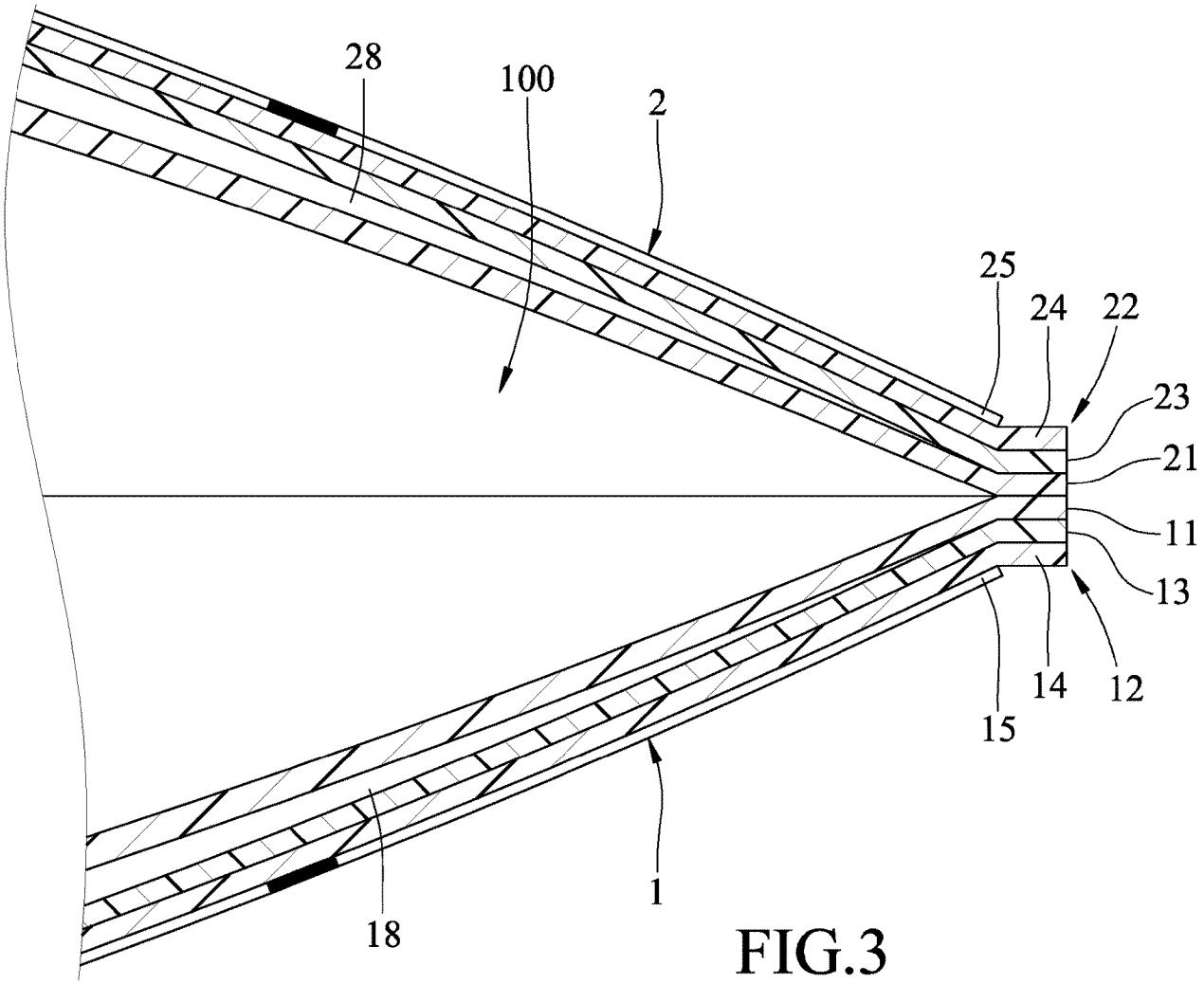
FIG. 3 is a fragmentary enlarged view of FIG. 2, illustrating lining layers and external layer structures of the first and second body parts of the first embodiment.

Referring to FIGS. 1 to 3, a first embodiment of a buoyancy dry bag according to the disclosure includes a first body part 1, a second body part 2, an air valve unit 3, a closing unit 4, and a hook unit 5.

The first and second body parts 1, 2 have the same outer contour, are connected to each other, and cooperatively define a receiving space 100 adapted for receiving personal items of a user. The receiving space 100 has a top opening.

The first body part 1 has a lining layer 11 and an external layer structure 12. The lining layer 11 is made of thermoplastic polyurethane (TPU), which is eco-friendly and non-toxic. The external layer structure 12 has an inner layer 13 disposed at an outer side of the lining layer 11, an outer layer 14 contacting an outer surface of the inner layer 13, and a pattern layer 15 contacting an outer surface of the outer layer 14. The inner layer 13 is made of thermoplastic polyurethane, and the outer layer 14 is made of polyester, which is non-toxic.

The second body part 2 has a lining layer 21 that is made of thermoplastic polyurethane, and an external layer structure 22 that has an inner layer 23 disposed at an outer side of the lining layer 21 and made of thermoplastic polyurethane, an outer layer 24 contacting an outer surface of the inner layer 23 and made of polyester, and a pattern layer 25.

The pattern layers 15, 25 can have various designs that are unique or fashionable. In the first embodiment, the pattern layers 15, 25 include line and dot patterns. Alternatively, the pattern layers 15, 25 may include different geometric patterns or other patterns that are printed on the outer surfaces of the outer layers 14, 24 of the external layer structures 12, 22. It should be noted that in a variation of the embodiment, one of the pattern layers 15, 25 may be omitted, that is, only one pattern layer 15, 25 is formed on one of the first and second body parts 1, 2.

Figure 4:
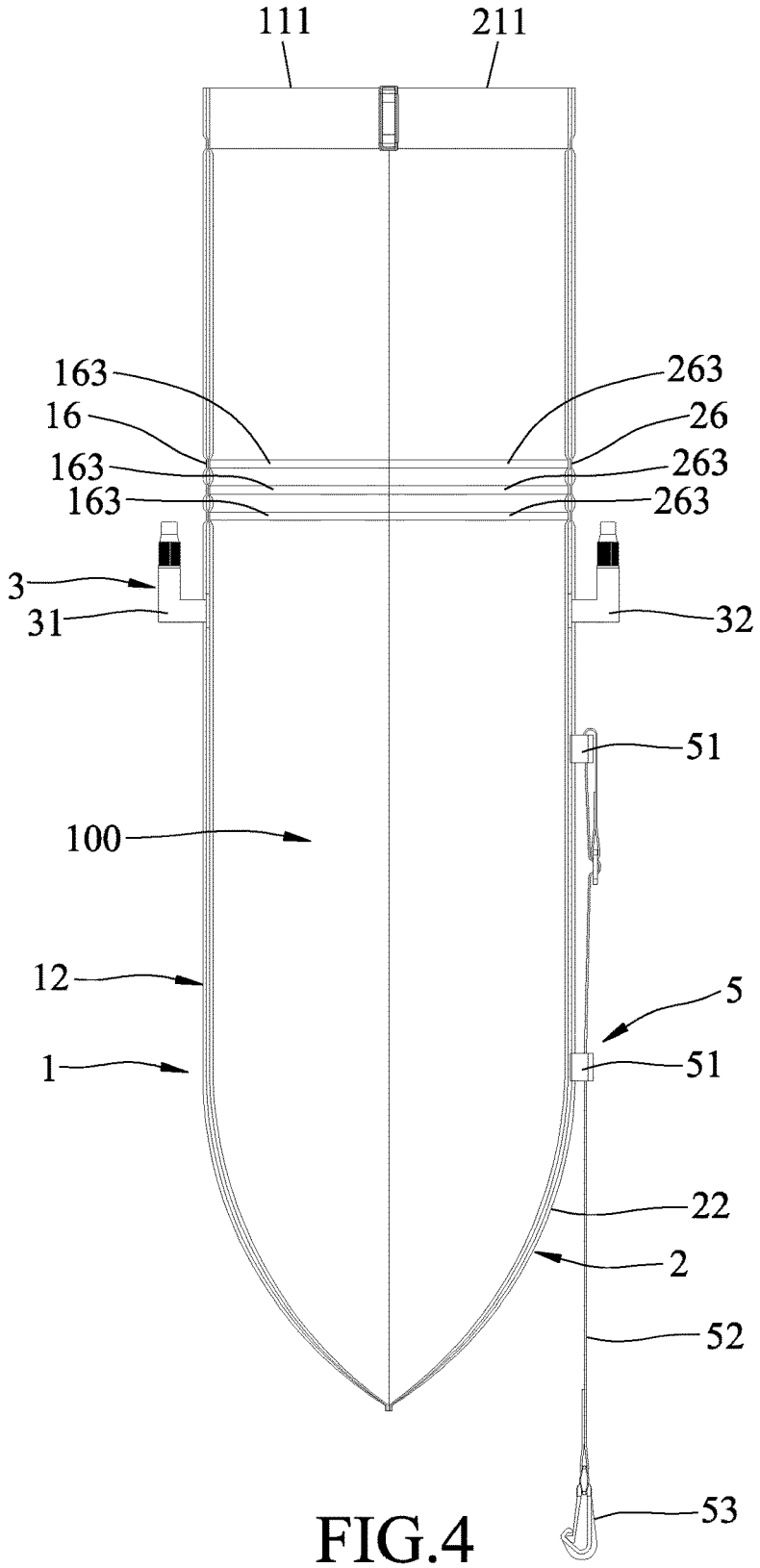
FIG. 4 is a sectional view taken along line IV-IV of FIG. 1, illustrating the first and second body parts of the first embodiment cooperatively defining a receiving space.

Referring to FIGS. 1, 2, and 4, the first body part 1 further has a top edge 111, and a connecting edge 112 that interconnects opposite ends of the top edge 111. The top edge 111 and the connecting edge 112 cooperatively define a periphery of the first body part 1. The first body part 1 further has a first sealing portion 16 and a second sealing portion 17. The first sealing portion 16 is spaced apart from the top edge 111 of the first body part 1, and includes a portion of the lining layer 11 and a portion of the external layer structure 12 sealed to the portion of the lining layer 11 to form a plurality of spaced-apart hot-melt lines 163 that are parallel to the top edge 111. The first sealing portion 16 has opposite first and second ends 161, 162 intersecting respectively opposite sections of the connecting edge 112 of the first body part 1. The second sealing portion 17 is U-shaped, extends along the connecting edge 112, and is connected to the first and second ends 161, 162 of the first sealing portion 16. The second sealing portion 17 includes another portion of the lining layer 11 and another portion of the external layer structure 12 sealed to the another portion of the lining layer 11. The first and second sealing portions 16, 17 cooperatively define a first air chamber 18 (see FIG. 3) between the lining layer 11 and the inner layer 13.

The second body part 2 further has a top edge 211, and a connecting edge 212 that interconnects opposite ends of the top edge 211. The top edge 211 and the connecting edge 212 of the second body part 2 cooperatively define a periphery of the second body part 2. The second body part 2 further has a first sealing portion 26 and a second sealing portion 27. The first sealing portion 26 of the second body part 2 is spaced apart from the top edge 211 of the second body part 2, and includes a portion of the lining layer 21 and a portion of the external layer structure 22 sealed to the portion of the lining layer 21 to form a plurality of spaced-apart hot-melt lines 263 that are parallel to the top edge 211. The second sealing portion 26 has opposite first and second ends 261, 262 intersecting respectively opposite sections of the connecting edge 212. The second sealing portion 27 of the second body part 2 extends along the connecting edge 212 of the second body part 2, is connected to the first and second ends 261, 262 of the first sealing portion 26, and that includes another portion of the lining layer 21 and another portion of the external layer structure 22 sealed to the another portion of the lining layer 21. The first and second sealing portions 26, 27 of the second body part 2 cooperatively define a second air chamber 28 (see FIG. 3) between the lining layer 21 and the inner layer 23.

In the first embodiment, for the first body part 1, the second sealing portion 17 has an initial point 171 and an end point 172 that are opposite to each other and that are proximate to and lower than the top edge 111. For the second body part 2, the second sealing portion 27 has an initial point 271 and an end point 272 that are opposite to each other and that are proximate to and lower than the top edge 211. For each of the first and second body parts 1, 2, the second sealing portion 17, 27 extends from the initial point 171, 271 to the end point 172, 272 along the connecting edge 112, 212 and is connected to the first and second ends 161, 162, 261, 262 of the first sealing portion 16, 26. In a variation of the first embodiment, for each of the first and second body parts 1, 2, the initial point 171, 271 and the endpoint 172, 272 of the second sealing portion 17, 27 may overlap respectively the first end 161, 261 and the second end 162, 262 of the first sealing portion 16, 26 (i.e., the second sealing portion 17, 27 may only extend from the first end 161, 261 to the second end 162, 262 of the first sealing portion 16, 26.)

Figure 5:
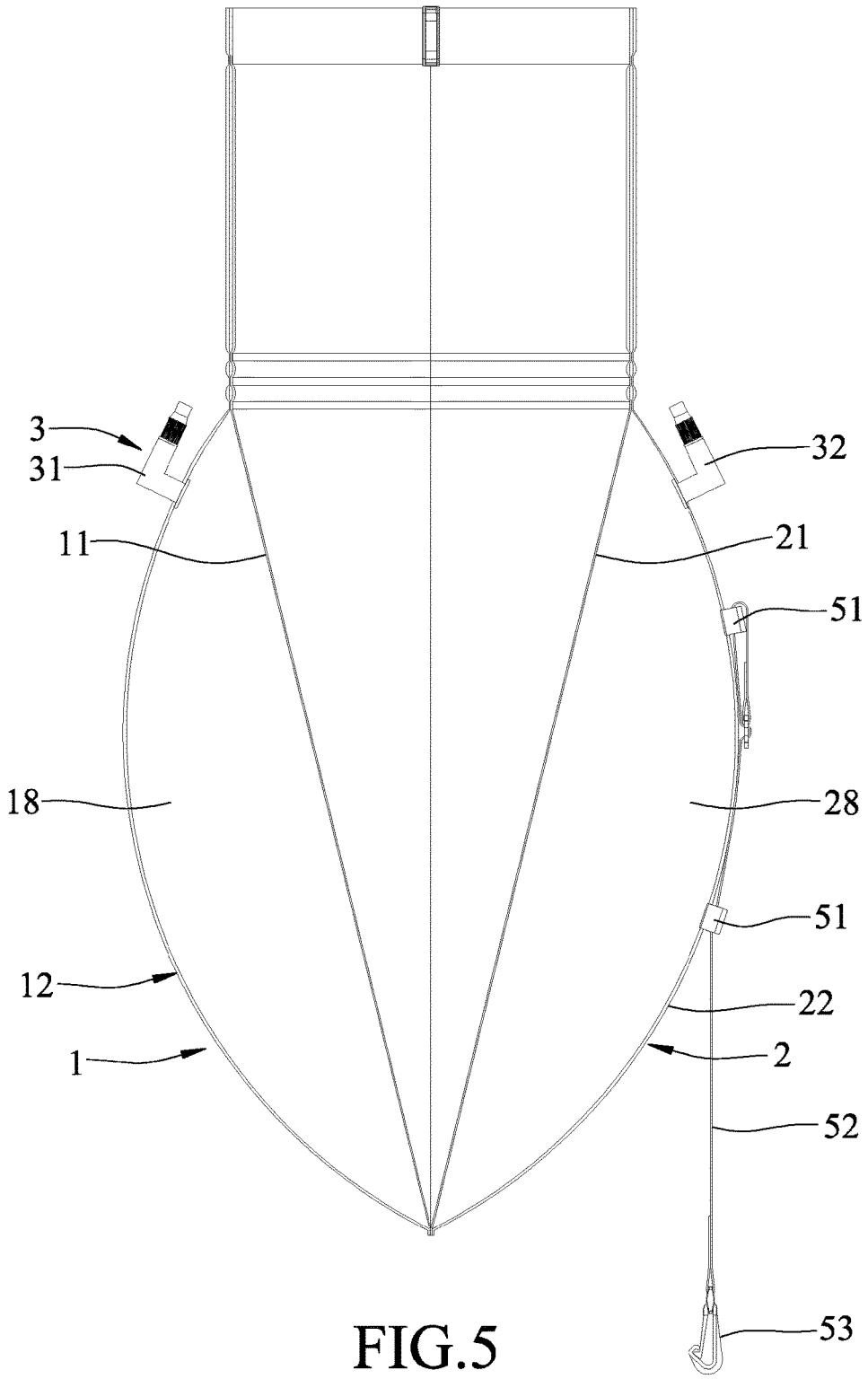
FIG. 5 is a view similar to FIG. 4, but illustrating air chambers of the first and second body parts of the first embodiment being inflated.

Referring to FIGS. 1, 4, and 5, the air valve unit 3 includes a first air valve 31 mounted to the external layer structure 12 of the first body part 1 and being openable to permit injection of air into the first air chamber 18 therethrough, and a second air valve 32 mounted to the external layer structure 22 of the second body part 2 and being openable to permit injection of air into the second air chamber 28 therethrough. As shown in FIG. 5, the first and second air chambers 18, 28 can be inflated with air to cooperatively form a ball shape. The first and second air chambers 18, 28 can be deflated via the first and second air valves 31, 32, respectively.

It should be noted that, in a variation of the first embodiment, one of the first and second air chambers 18, 28 and a corresponding one of the first and second air valves 31, 32 may be omitted. That is, the buoyancy dry bag may only have one air chamber 18, 28 and one air valve 31, 32 as long as the buoyancy dry bag can serve as a floating device for a user. In addition, when the buoyancy dry bag is configured with only one pattern layer 15, 25 and only one air chamber 18, 28, the pattern layer 15, 25 and the air chamber 18, 28 may be formed on the first body part 1 or on the second body part 2. Alternatively, the pattern layer 15, 25 may be formed on one of the first and second body parts 1, 2, and the air chamber 18, 28 may be formed on the other one of the first and second body parts 1, 2.

As shown in FIG. 1, the closing unit 4 includes a buckle strap 41 and two buckle members 42. The buckle strap 41 is disposed on inner surfaces of the lining layers 11, 21 of the first and second body parts 1, 2, and is proximate to top edges 111, 211 of the first and second body parts 1, 2. The buckle members 42 are connected respectively to opposite ends of the buckle strap 41, and are movable to engage each other to close the receiving space 100.

After a user puts his/her personal items in the receiving space 100 and is ready to seal the receiving space 100, the first and second body parts 1, 2 can be folded over from the top edges 111, 211 to expose the closing unit 4, and the first and second body parts 1, 2 can then be further folded over to surround the buckle strap 41 for multiple times. Afterwards, the buckle members 42 can be moved toward a center of the closing unit 4 to engage each other. In this way, the receiving space 100 is sealingly closed.

The hook unit 5 is mounted to an outer surface of the external layer structure 12, 22 of one of the first and second body parts 1, 2, and is configured for hanging the buoyancy dry bag on a user's body. In the first embodiment, referring to FIG. 4, the hook unit 5 is mounted to the second body part 2, and includes two spaced-apart positioning members 51 that are disposed on the external layer structure 22 of the second body part 2, a strap member 52 that extends through the positioning members 51 and that has a length being adjustable, and a hook member 53 that is disposed at a bottom end of the strap member 52 and that can be hooked on a user's body so that the buoyancy dry bag is movable together with the user in water for alarming purpose.

Figure 6:
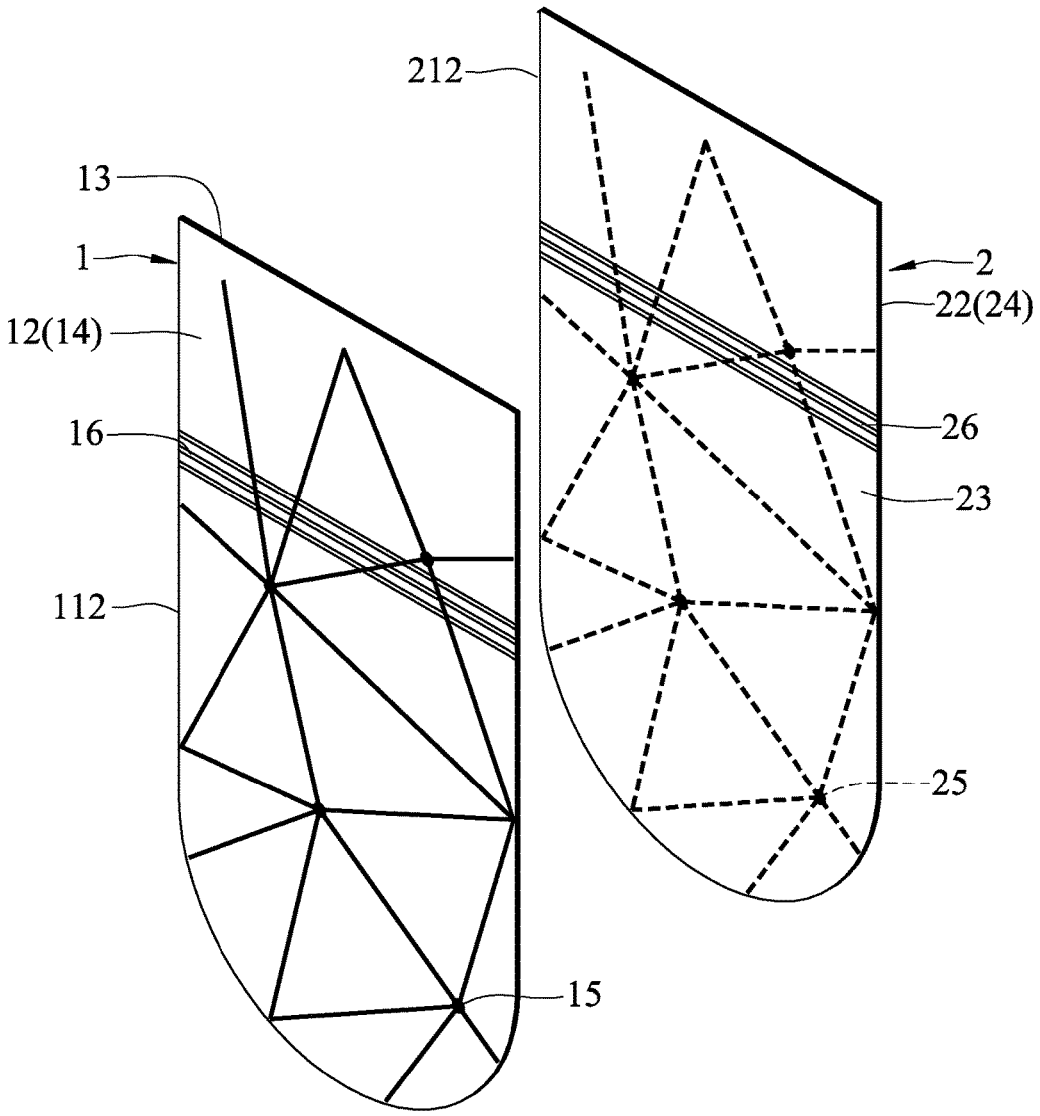
FIG. 6 is an exploded perspective view of the first and second body parts of the first embodiment, illustrating first sealing portions of the first and second body parts.
Figure 7:
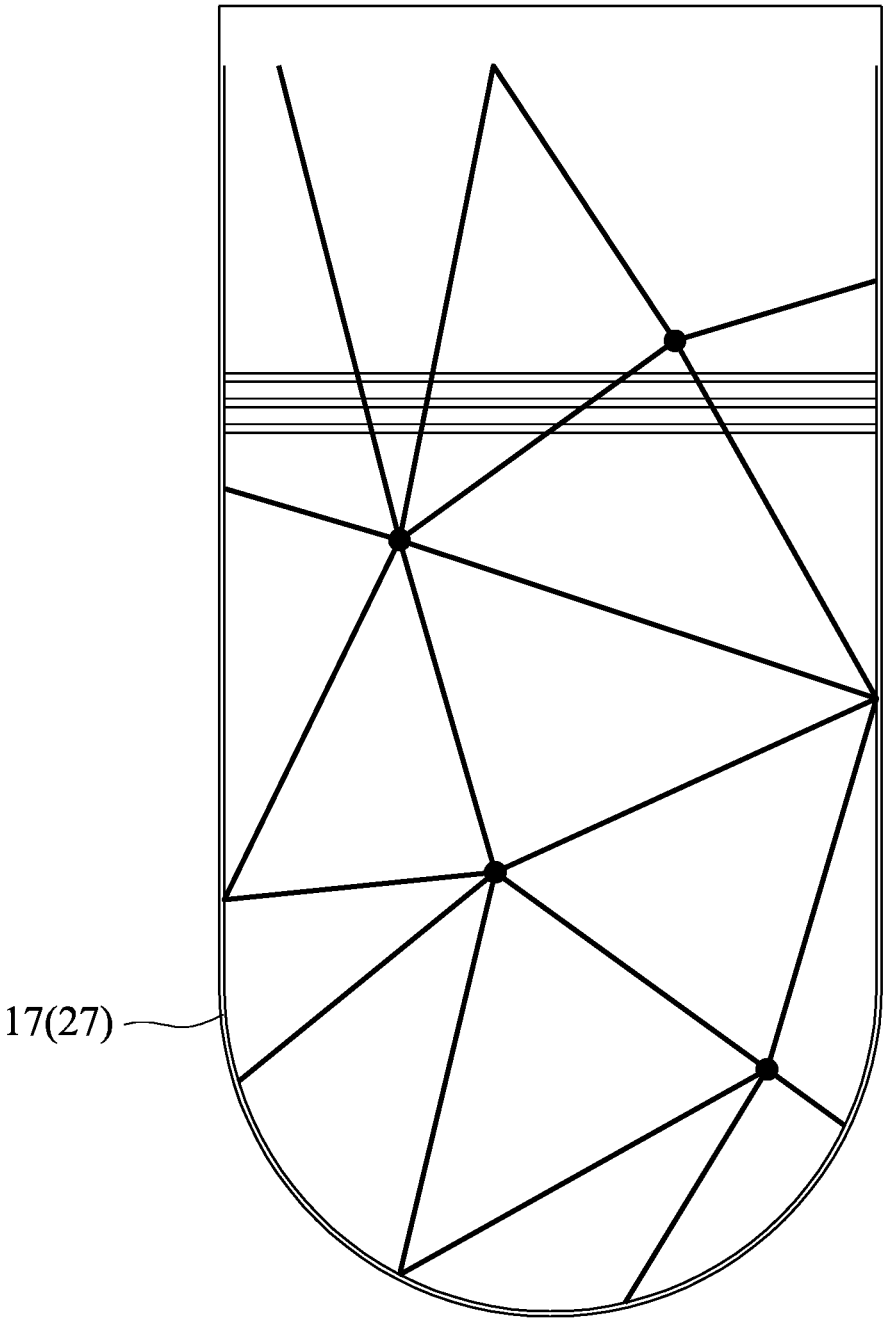
FIG. 7 is a front view of the first and second body parts of the first embodiment, illustrating second sealing portions of the first and second body parts being connected.

Referring to FIGS. 3, 6, and 7, during manufacturing, for each of the first and second body parts 1, 2, the inner layer 13, 23 of the external layer structure 12, 22 and the lining layer 11, 21 are first heat welded so as to form the first sealing portion 16, 26. Afterwards, the lining layers 11, 21 of the first and second body parts 1, 2 are overlapped and the connecting edges 112, 212 of the first and second body parts 1, 2 are heat welded, so that the lining layers 11, 21 are connected, and that the lining layer 11, 21 and the respective outer layer 14, 24 of each of the first and second body parts 1, 2 are connected. At this time, the second sealing portions 17, 27 are formed and are connected to each other, and the first and second air chambers 18, 28 and the receiving space 100 are formed.

In summary, the air bag of the first embodiment has the following advantages:

1. Since the outer layers 14, 24 of the external layer structures 12, 22 are made of polyester, coloring or printing patterns on the outer surfaces of the outer layers 14, 24 can be performed easily and successfully, so that the buoyancy dry bag can have various design patterns that are unique or fashionable.
2. Since the lining layers 11, 21 and the inner layers 13, 23 of the external layer structures 12, 22 are made of thermoplastic polyurethane, the lining layers 11, 21 and the external layer structures 12, 22 are well connected when the connecting edges 112, 212 are heat welded, thus the buoyancy dry bag of the disclosure has a simple and easy manufacturing process.

Figure 8:
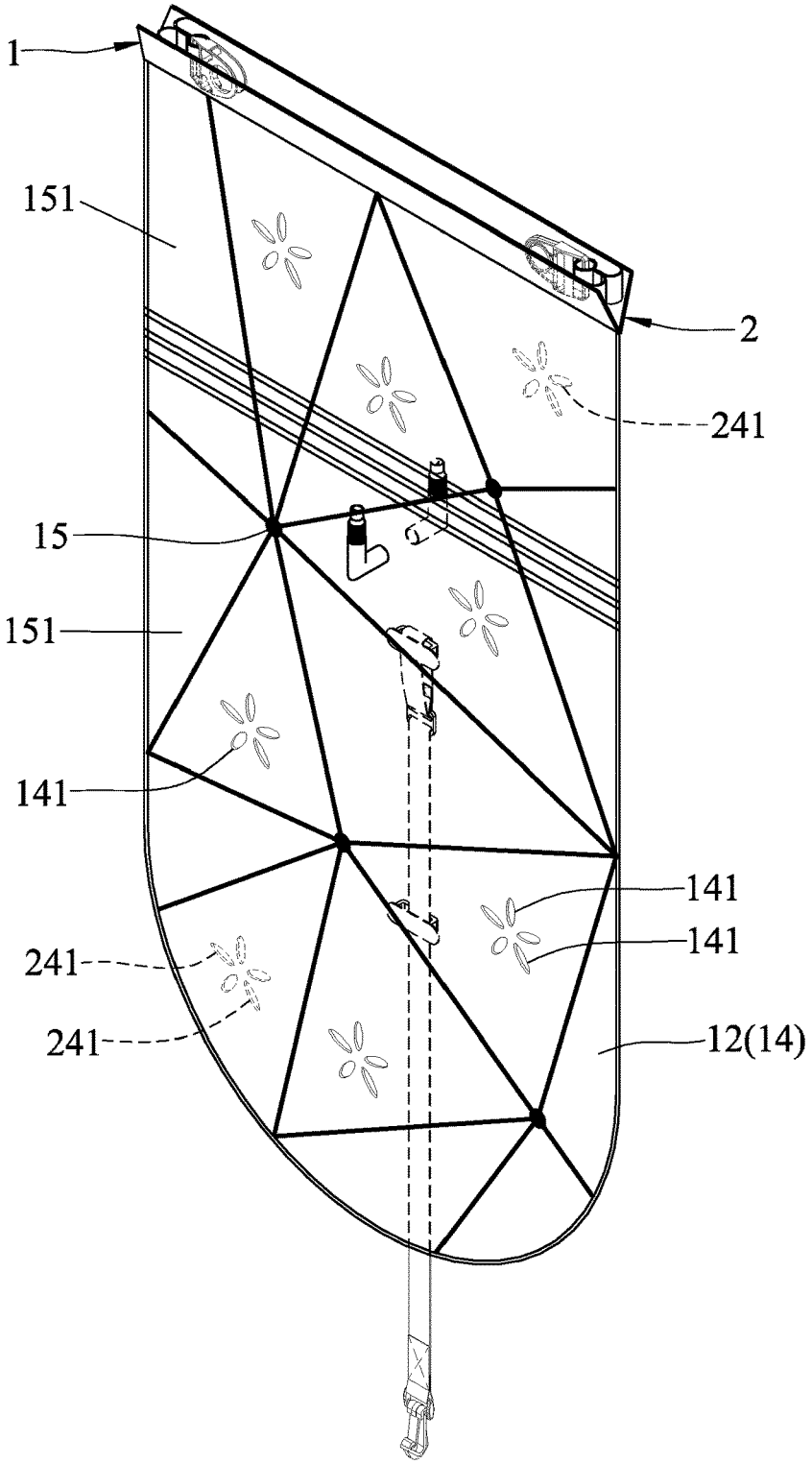
FIG. 8 is a perspective view illustrating a second embodiment of the buoyancy dry bag according to the disclosure.

Referring to FIG. 8, a second embodiment of the buoyancy dry bag of the disclosure is similar to the first embodiment, the difference resides in that the outer layers 14, 24 of the external layer structures 12, 22 of the first and second body parts 1, 2 are formed with a plurality of through holes 141. In the second embodiment, the through holes 141 are formed by using laser engraving technique. It should be noted that by using this technique, when the pattern layers 15, 25 are configured to cover the entire outer layers 14, 24, the pattern layers 15, 25 are simultaneously formed with a plurality of through holes (not shown) which correspond in position and shape to the through holes 141.

In addition, in a variation of the second embodiment, the through holes 141 may be formed only in the outer layer 14, 24 of one of the first and second body parts 1, 2. The through holes 141 of the second embodiment provide variety to the design of the buoyancy dry bag.

In the second embodiment, the pattern layer 15 of the external layer structure 12 of the first body part 1 is formed with a plurality of through holes 151 which do not correspond in position and shape to the through holes 141. As shown in FIG. 8, the through holes 141 of the outer layer 14 form multiple flower patterns, and the though holes 151 of the pattern layer 15 are substantially triangular and quadrilateral in shape.

Figure 9:
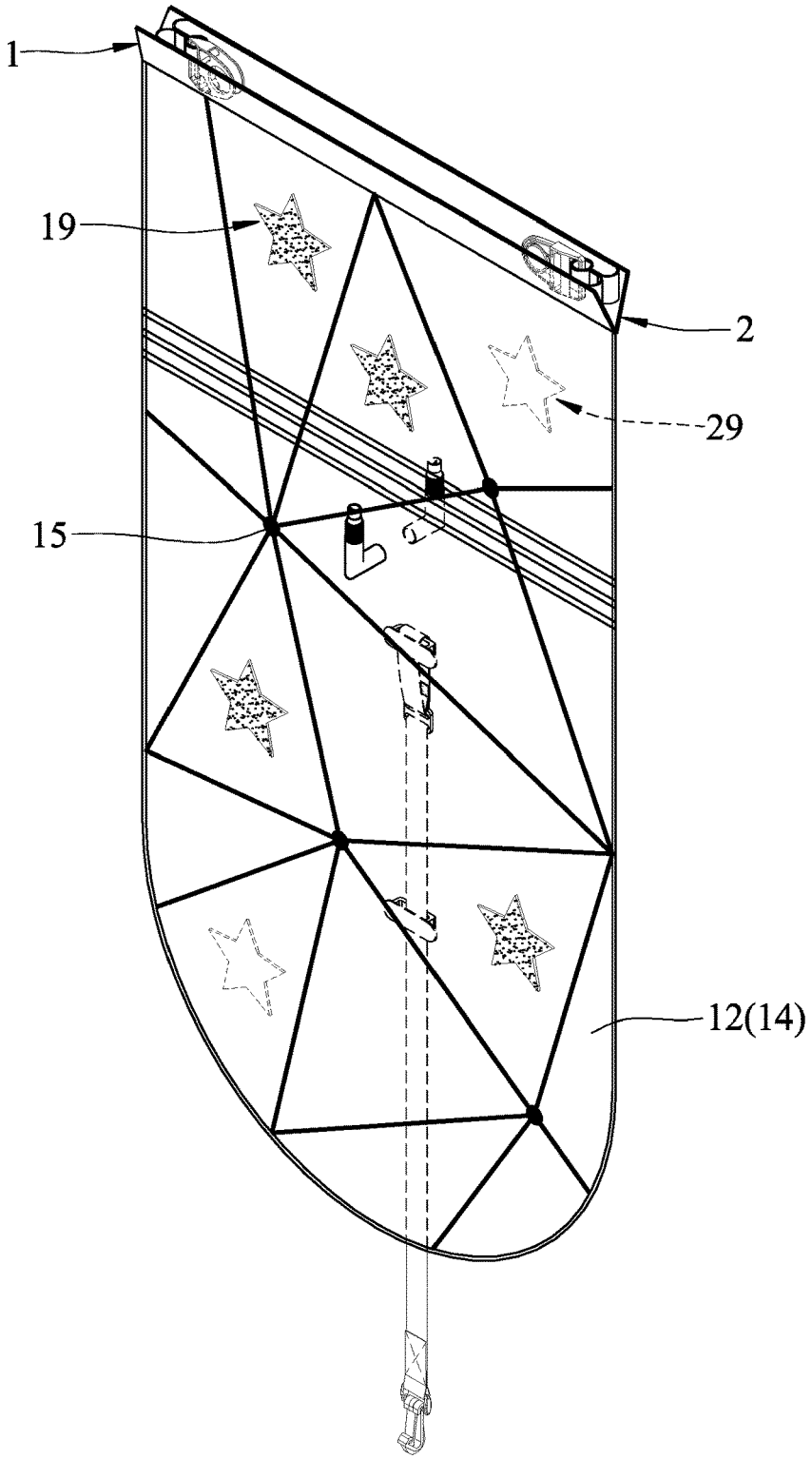
FIG. 9 is a perspective view illustrating a third embodiment of the buoyancy dry bag according to the disclosure.

Referring to FIG. 9, a third embodiment of the buoyancy dry bag of the disclosure is similar to the first embodiment, the difference resides in that each of the first and second body parts 1, 2 further has a decorating layer 19, 29 that is disposed on the outer surface of the outer layer 14, 24. In the third embodiment, the decorating layers 19, 29 are made of polyurethane foam material and are respectively attached to the outer surfaces of the outer layers 14, 24. Each of the decorating layers 19, 29 includes a plurality of star-shaped segments.

In a variation of the third embodiment, the decorating layer 19 may be formed only in one of the outer layers 14, 24 of the first and second body parts 1, 2. The design of the decorating layers 19, 29 provides stereoscopic visual effect and may attract visual attention.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A buoyancy dry bag comprising:

first and second body parts connected to each other and cooperatively defining a receiving space, said receiving space having a top opening, said first body part having a lining layer that is made of thermoplastic polyurethane, and an external layer structure that has an inner layer disposed at an outer side of said lining layer and made of thermoplastic polyurethane, an outer layer contacting an outer surface of said inner layer and made of polyester, and a pattern layer contacting an outer surface of said outer layer, said first body part further having a top edge, and a connecting edge that interconnects opposite ends of said top edge, said top edge and said connecting edge cooperatively defining a periphery of said first body part, said first body part further having a first sealing portion that is spaced apart from said top edge of said first body part, that includes a portion of said lining layer and a portion of said external layer structure sealed to said portion of said lining layer, and that has opposite first and second ends intersecting respectively opposite sections of said connecting edge of said first body part, and a second sealing portion that extends along said connecting edge, that is connected to said first and second ends of said first sealing portion, and that includes another portion of said lining layer and another portion of said external layer structure sealed to said another portion of said lining layer, said first and second sealing portions cooperatively defining a first air chamber between said lining layer and said inner layer; and an air valve unit including a first air valve mounted to said external layer structure of said first body part and being openable to permit injection of air into said first air chamber therethrough.

2. The buoyancy dry bag as claimed in claim 1, wherein:

said second body part has a lining layer that is made of thermoplastic polyurethane, and an external layer structure that has an inner layer disposed at an outer side of said lining layer and made of thermoplastic polyurethane, and an outer layer contacting an outer surface of said inner layer and made of polyester;

said second body part further has a top edge, and a connecting edge that interconnects opposite ends of said top edge, said top edge and said connecting edge cooperatively defining a periphery of said second body part;

said second body part further has a first sealing portion that is spaced apart from said top edge of said second body part, that includes a portion of said lining layer and a portion of said external layer structure sealed to said portion of said lining layer, and that has opposite first and second ends intersecting respectively opposite sections of said connecting edge, and a second sealing portion that extends along said connecting edge of said second body part, that is connected to said first and second ends of said first sealing portion, and that includes another portion of said lining layer and another portion of said external layer structure sealed to said another portion of said lining layer, said first and second sealing portions cooperatively de fining a second air chamber between said lining layer and said inner layer; and said air valve unit further includes a second air valve mounted to said external layer structure of said second body part and being openable to permit injection of air into said second air chamber therethrough.

3. The buoyancy dry bag as claimed in claim 2, further comprising a hook unit that is mounted to said external layer structure of one of said first and second body parts.

4. The buoyancy dry bag as claimed in claim 3, further comprising a closing unit that includes:

a buckle strap disposed on said lining layers of said first and second body parts, and being proximate to top edges of said first and second body parts; and two buckle members connected respectively to opposite ends of said buckle strap, and being movable to engage each other to close said receiving space.

5. The buoyancy dry bag as claimed in claim 2, wherein:

said second sealing portion of said first body part has an initial point and an end point that are opposite to each other and that are proximate to said top edge of said first body part; and said second sealing portion of said second body part has an initial point and an end point that are opposite to each other and that are proximate to said top edge of said second body part.

6. The buoyancy dry bag as claimed in claim 5, wherein said second sealing portion of each of said first and second body parts is U-shaped.

7. The buoyancy dry bag as claimed in claim 2, wherein said outer layer of said external layer structure of at least one of said first and second body parts is formed with a plurality of through holes.

8. The buoyancy dry bag as claimed in claim 2, wherein said pattern layer of said external layer structure of said first body part is formed with a plurality of through holes.

9. The buoyancy dry bag as claimed in claim 2, wherein at least one of said first and second body parts further has a decorating layer that is disposed on said outer surface of said outer layer.

10. The buoyancy dry bag as claimed in claim 9, wherein said decorating layer is made of polyurethane foam material.

* * * * *